US006608981B2

(12) United States Patent
Mae

(10) Patent No.: US 6,608,981 B2
(45) Date of Patent: Aug. 19, 2003

(54) IMAGE FORMING APPARATUS HAVING COMMON GUIDE MEMBERS FOR DETACHABLY ATTACHING A DEVELOPING UNIT AND A CARRIER UNIT

(75) Inventor: Toshiyuki Mae, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/873,245

(22) Filed: Jun. 5, 2001

(65) Prior Publication Data

US 2002/0012547 A1 Jan. 31, 2002

(30) Foreign Application Priority Data

Jun. 5, 2000 (JP) ..... 2000-168146
May 7, 2001 (JP) ..... 2001-136258

(51) Int. Cl.[7] ..... G03G 15/02
(52) U.S. Cl. ..... 399/116; 399/117
(58) Field of Search ..... 399/107, 110, 399/111, 112, 116, 117, 258, 299, 302, 307, 119

(56) References Cited

U.S. PATENT DOCUMENTS

| | | | | |
|---|---|---|---|---|
| 5,303,018 | A | 4/1994 | Terada et al. | 399/299 |
| 5,339,141 | A | 8/1994 | Suzuki et al. | 399/285 |
| 5,424,814 | A | 6/1995 | Suzuki et al. | 399/284 |
| 5,440,373 | A | 8/1995 | Deki et al. | 399/302 |
| 5,512,984 | A | 4/1996 | Kimura et al. | 399/228 |
| 5,515,145 | A | 5/1996 | Sasaki et al. | 399/113 |
| 5,537,197 | A | 7/1996 | Fujishiro et al. | 399/228 |
| 5,565,973 | A | 10/1996 | Fujishiro et al. | 399/227 |
| 5,583,630 | A | 12/1996 | Kimura et al. | 399/227 |
| 5,621,221 | A | 4/1997 | Shinohara et al. | 250/576 |
| 5,655,193 | A | 8/1997 | Fujishiro et al. | 399/256 |
| 5,671,465 | A | 9/1997 | Kimura et al. | 399/119 |
| 5,737,665 | A | 4/1998 | Sugiyama et al. | 399/39 |
| 5,765,083 | A | 6/1998 | Shinohara | 399/301 |
| 5,842,095 | A * | 11/1998 | Kitamura | 399/299 |
| 5,875,380 | A | 2/1999 | Iwata et al. | 399/301 |
| 5,899,597 | A | 5/1999 | Shinohara et al. | 399/64 |
| 5,953,559 | A * | 9/1999 | Obu | 399/110 |
| 5,953,568 | A | 9/1999 | Fujishiro et al. | 399/267 |
| 5,962,783 | A | 10/1999 | Iwata et al. | 73/488 |
| 5,963,240 | A | 10/1999 | Shinohara et al. | 347/116 |
| 6,061,537 | A * | 5/2000 | Nakajima et al. | 399/107 |
| 6,070,030 | A | 5/2000 | Fujishiro | 399/111 |
| 6,118,557 | A | 9/2000 | Sugiyama et al. | 358/504 |
| 6,122,468 | A | 9/2000 | Sakamoto et al. | 399/223 |
| 6,128,459 | A | 10/2000 | Iwata et al. | 399/301 |
| 6,249,304 | B1 | 6/2001 | Sawayama et al. | 347/228 |
| 6,282,396 | B1 | 8/2001 | Iwata et al. | 399/301 |
| 6,289,189 | B1 * | 9/2001 | Numagami et al. | 399/111 |
| 6,295,435 | B1 | 9/2001 | Shinohara et al. | 399/301 |
| 6,295,438 | B1 | 9/2001 | Fujishiro et al. | 399/346 |
| 6,308,027 | B1 | 10/2001 | Obu et al. | 399/110 |
| 6,324,370 | B1 * | 11/2001 | Isobe et al. | 399/258 |
| 6,380,960 | B1 | 4/2002 | Shinohara | 347/116 |
| 6,381,435 | B2 | 4/2002 | Shinohara et al. | 399/301 |

FOREIGN PATENT DOCUMENTS

| | | |
|---|---|---|
| EP | 0 915 388 | 5/1999 |
| JP | 10-288877 | 10/1998 |
| JP | 11-231755 | 8/1999 |
| JP | 2000-35702 | 2/2000 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus including a plurality of image making units each including a carrier unit and a developing unit, the carrier unit having an image carrier for forming a latent image thereon, the developing unit having a developing device configured to develop the latent image formed on a respective one of the image carriers into a toner image, and a plurality of common guide members each configured to guide a respective one of the developing units in one of the plurality of image making units and a respective one of the carrier units in another one of the plurality of image making units when the plurality of image making units are attached to or detached from the image forming apparatus.

10 Claims, 5 Drawing Sheets

IMAGE FORMING APPARATUS HAVING COMMON GUIDE MEMBERS FOR DETACHABLY ATTACHING A DEVELOPING UNIT AND A CARRIER UNIT

FIELD OF THE INVENTION

The present invention relates to an image forming apparatus such as an electronic copier, a printer, a facsimile, or a complex machine.

BACKGROUND OF THE INVENTION

The present invention relates to an image forming apparatus in which of a transfer the developing units and carrier units in the image making units are individually independently attachably and detachably mounted to an image forming apparatus body, and toner images formed on the image carriers in the image making units are transferred to a transfer material.

However, for the developing units and the carrier units to be individually attachable to and detachable from the image forming apparatus body, it is necessary to provide a guide member for a developing unit of each image making unit and another guide member for a carrier unit of each image making unit, thus resulting in an increase in number of components of the image forming apparatus, with an unavoidable increase in cost therefor, as a disadvantage.

SUMMARY OF THE INVENTION

It is an object of the present invention to provide an image forming apparatus of the above-noted type with the disadvantage eliminated.

The present invention relates to an image forming apparatus in which image making unit provided with developing units having at least developing devices and carrier units having image carriers for toner images to be formed thereon by the developing devices and supports for supporting the image carriers are disposed at least two along a moving direction of a transfer material, the developing units and the carrier units of the image making unit are individually independently attachably and detachably mounted to an image forming apparatus body, and the toner images formed on the image carriers of the image making unit are transferred to the transfer material.

A first aspect of the present invention provides an image forming apparatus of the above-noted type, wherein a common guide member adapted, when a carrier unit of one image making unit of two image making unit neighboring each other and a developing unit of the other image making unit are attached to or detached from the image forming apparatus body, for guiding the carrier unit and the developing unit respectively is provided.

According to a second aspect of the invention, preferably, at least part of a carrier unit of one image making unit of the two image making unit neighboring each other that is positioned upstream in a transfer direction of the transfer material is positioned under a developing unit of the other image making unit positioned downstream in the transfer direction of the transfer material.

A third aspect of the present invention provides an image forming apparatus according to the second aspect, wherein, preferably, the carrier unit of the image making unit of the two image making unit neighboring each other that is positioned upstream in the transfer direction of the transfer material is supported by a part of the guide member lower than the developing unit of the image making unit positioned downstream in the transfer direction of the transfer material.

Further, a fourth aspect of the present invention provides an image forming apparatus according to the third aspect, wherein, preferably, the carrier unit of the image making unit of the two image making unit neighboring each other that is positioned upstream in the transfer direction of the transfer material is supported by the guide member, in a condition suspended by the guide member, and the developing unit of the image making unit positioned downstream in the transfer direction of the transfer material is supported by the guide member, in a condition fitted to an upper part of the guide member.

A fifth aspect of the present invention provides an image forming apparatus according to the fourth aspect, wherein, preferably, the carrier unit is suspended by the guide member at two points, and an image carrier of the carrier unit is positioned under both suspending parts.

A sixth aspect of the present invention provides an image forming apparatus according to the fifth aspect, wherein, preferably, the carrier unit is suspended at the two points spaced from each other in a horizontal direction of the guide member, and a center of gravity of the carrier unit is positioned under an area between the both suspending parts.

A seventh aspect of the present invention provides an image forming apparatus according to any of the first to sixth aspects, wherein, preferably, the carrier unit and the developing unit are attached to or detached from the image forming apparatus body, in conditions supported by the guide member, by pushing substantially in a horizontal direction relative to the image forming apparatus body or by drawing out, and when the carrier unit is being attached to or detached from the image forming apparatus body, in order for a moment due to an own weight of the carrier unit not to act on the carrier unit, the carrier unit is supported in a horizontal condition by the guide.

An eighth aspect of the present invention provides an image forming apparatus according to any of the first to seventh aspects, wherein, preferably, the carrier unit and the developing unit are attached to or detached from the image forming apparatus body, in conditions supported by the guide member, by pushing substantially in a horizontal direction relative to the image forming apparatus body or by drawing out, and when the developing unit is being attached to or detached from the image forming apparatus body, in order for a moment due to an own weight of the developing unit to act on the developing unit, the developing unit is supported by the guide member, and an auxiliary guide member for preventing the developing unit from being inclined by the moment, when the developing unit is being attached to or detached from the image forming apparatus body, is provided.

A ninth aspect of the present invention provides an image forming apparatus according to any of the first to eighth aspects, wherein, preferably, toner transfer pumps for transferring toners to the developing devices of the image making unit respectively and toner accommodation containers connected via conduits to the toner transfer pumps and accommodating toners to be sent to the toner transfer pumps are provided, and the conduits are at least partially disposed on the guide member.

Other objects and features of this invention will become apparent from the following description with reference to the accompanying drawings.

DESCRIPTION OF THE PREFERRED EMBODIMENTS

There will be detailed below the preferred embodiments of the present invention with reference to the accompanying drawings.

Figure 1:
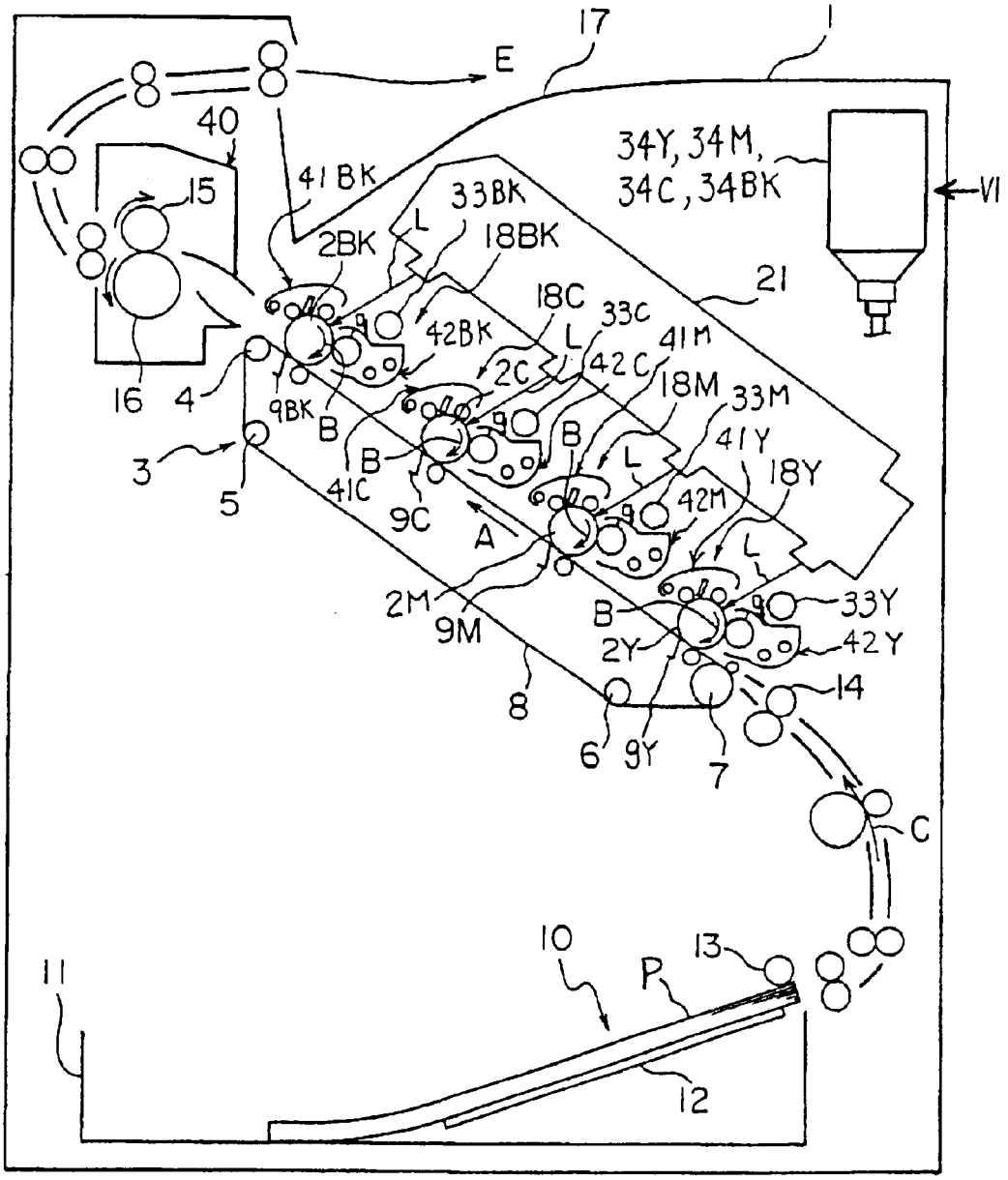
FIG. 1 is a vertical sectional view of an image forming apparatus according to an embodiment of the invention.

FIG. 1 is a schematic vertical sectional view of a color printer as an image forming apparatus according to an embodiment of the invention. The image forming apparatus 1 has therein a plurality of image making unit 18Y, 18M, 18C, and 18BK, four in total in the shown embodiment, arrayed along a direction A of conveyance of a later-described transfer material.

The image making unit have their image carriers 2Y, 2M, 2C, and 2BK constituted as drum-shaped photo sensors to be implemented: in the present embodiment, as an image carrier 2Y disposed most-upstream in the conveyance direction A of the transfer material for a yellow toner image to be formed on the surface, as a subsequent image carrier 2M for a magenta toner image to be formed on the surface, as a still subsequent image carrier 2C for a cyan toner image to be formed on the surface, and as a yet subsequent image carrier 2BK for a black toner image to be formed on the surface. The image carriers 2Y, 2M, 2C, and 2BK are each respectively driven for rotation in a direction of arrow B. The drum-shaped image carriers may be replaced by an endless-belt like image carrier applied over a plurality of rollers, to be driven for round travel. The photo sensors may be substituted with image carriers made of a dielectric substance.

In the following description, such image carriers will collectively be referred to as an image carrier 2Y for yellow, an image carrier 2M for magenta, an image carrier 2C for cyan, and an image carrier 2BK for black.

In opposition to the image carriers 2Y, 2M, 2C, and 2BK, there is disposed a transfer material conveyor 3 which has in the present embodiment a plurality of supporting rollers 4, 5, 6, and 7, and a transfer belt 8 as an endless belt applied over the supporting rollers 4, 5, 6, and 7, and in which one supporting roller 4 is driven for counterclockwise rotation in FIG. 1 to thereby drive the transfer belt 8 into its rotation in the conveyance direction A of the transfer material. The image carriers 2Y, 2M, 2C, and 2BK abut on a surface of a side of the transfer belt 8 in such movement, and in respective positions that are opposite to the image carriers, with the transfer belt 8 in between, there are disposed transfer brushes 9Y, 9M, 9C, and 9BK as exemplary transfer unit for transferring toner images on the image carriers onto the transfer material. There may be employed other transfer unit such as transfer rollers, transfer blades, or corona dischargers, in place of the transfer brushes. The image carriers may always be kept in abutment on the transfer belt 8, or otherwise the transfer belt 8 may be spaced from any image carrier except when this image carrier is brought into abutment on the transfer belt 8, via a transfer material, for transferring a toner image on the image carrier onto the transfer material.

In a lower part of the image forming apparatus 1 is provided a cassette 11 of a transfer material supply device 10, which has a quantity of transfer material P placed on a bottom plate 12 disposed in the cassette 11. As the transfer material, there may be used a sheet-shaped flexible piece such as a sheet of transfer paper, a resin film, or a resin sheet. As a feed roller 13 abutting on an upside of an uppermost sheet of transfer material P is driven to rotate counterclockwise, the uppermost sheet of transfer material P is fed in a direction of arrow C, and the fed sheet of transfer material P is further fed by rotation of a pair of resistor rollers 14, to be sent in predetermined timings to toner image transfer regions between the transfer belt 8 and the image carriers 2Y, 2M, 2C, and 2BK.

The image carrier 2Y for yellow has a yellow toner image formed on the surface as described, and when a sheet of transfer material P carried to be conveyed by the transfer belt 8 passes a toner image transfer region between the transfer belt 8 and the image carrier 2Y, the transfer brush 9Y which then has a transfer voltage imposed thereon with a polarity to be reverse to the polarity of charges on a surface of the image carrier 2Y takes an action, whereby the yellow toner image formed on the surface of the image carrier 2Y is transferred to a surface of the sheet of transfer material P. This sheet of transfer material P is carried by the transfer belt 8 and sequentially passes respective image transfer regions between the transfer belt 8 and the image carrier 2M for magenta, image carrier 3C for cyan, and image carrier 2BK for black, where, by actions of the transfer brushes 9M, 9C, and 9BK, respective colored toner images on the image carriers 2M, 2C, and 2BK are sequentially transferred to be superposed on the yellow toner image that has been already transferred onto the sheet of transfer material P. Like this, toner images formed on image carriers of the respective image making unit are sequentially transferred onto a sheet of transfer material P.

The sheet of transfer material P having superposed toner images of four colors transferred on the surface as described separates from the transfer belt 8 and passes a fixing device 40. The fixing device 40 has a fixing roller 15 and a pressing roller 16 to be driven for rotation in respective arrow directions, and the sheet of transfer material P passes between the rollers 15 and 16, receiving heat and pressure therefrom, whereby the toner image is fixed on the surface of the sheet of transfer material P. Then, the sheet of transfer material P is discharged outside a housing as a body of the image forming apparatus, as indicated by arrow E, to be stacked on a sheet discharge tray 17 constituted by a top wall of the housing of the image forming apparatus.

Although in the image forming apparatus shown in FIG. 1 there are provided four image making unit 18Y, 18M, 18C, and 18BK, the number may be adequately set to two or more. The present invention is applicable to an image forming apparatus in which at least two image making unit are disposed along a moving direction of a transfer material.

In the image forming apparatus in the present embodiment, all the image making unit 18Y, 18M, 18C, and 18BK shown in FIG. 1 are substantially identical in arrangement. For the image making unit 18Y as one of them having the image carrier 2Y for yellow, its basic function and actions will be described below with reference to FIG. 2.

Figure 2:
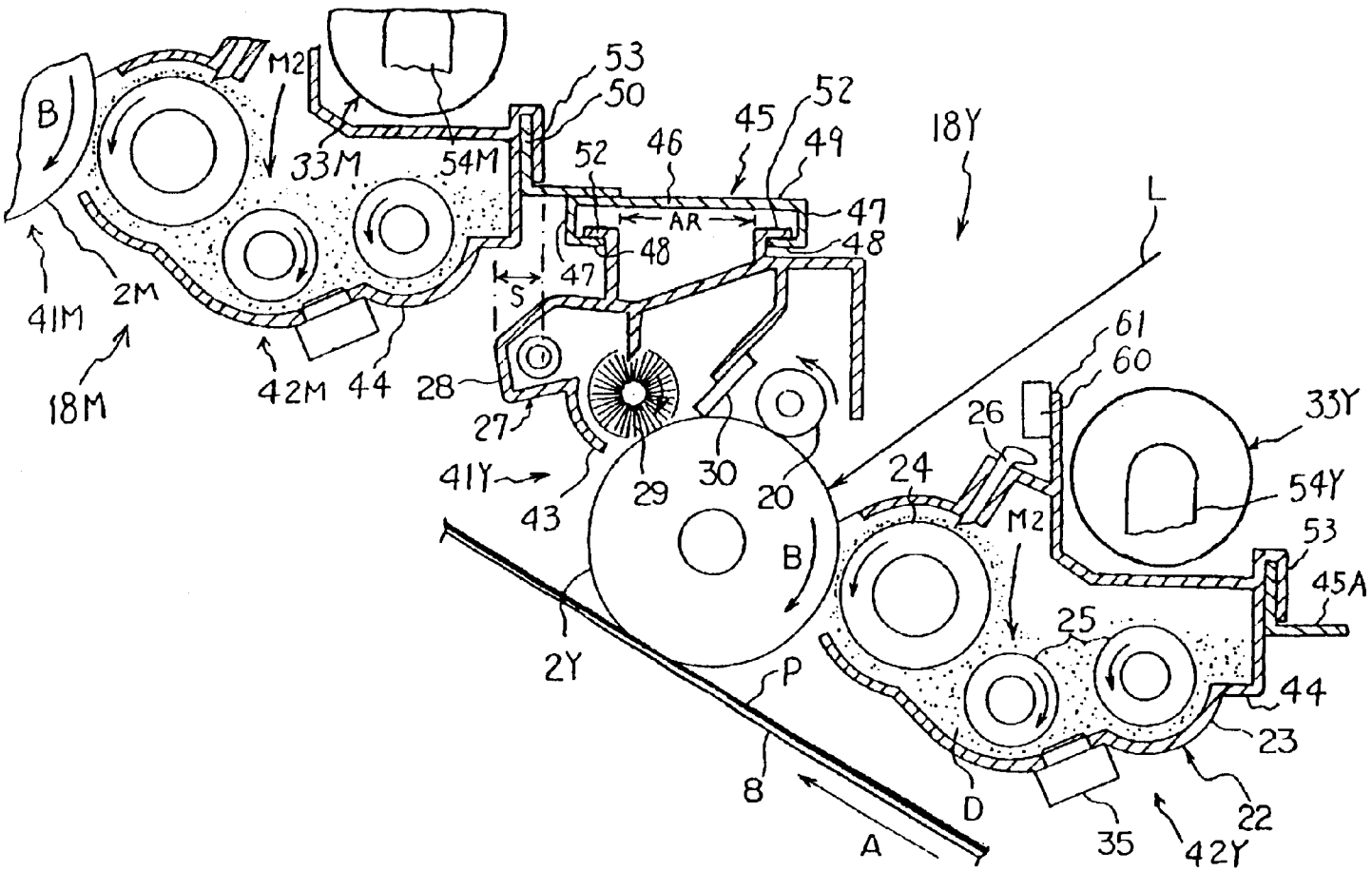
FIG. 2 is an enlarged fragmentary view of the image forming apparatus of FIG. 1, with a guide member inclusive.

As shown in FIG. 2, the image making unit 18Y is provided with a development unit 42Y having at least a developing device 22, and a carrier unit 41Y having at least the above-noted image carrier 2Y for a toner image to be formed by the developing device 22 and a support for supporting the image carrier 2Y, the support being constituted by a unit case 43 in the embodiment shown. The carrier unit 41Y in the present embodiment has, besides the image carrier 2Y and the unit case 43, a cleaning device 27 and a charging roller 20 as an exemplary charging device. The image carrier 2Y and the charging roller 20 are rotatably assembled to the unit case 43 of the carrier unit 41Y. The image carrier 2Y is driven for ration in the direction of arrow B, by a drive (not shown) provided on the side of the body 1 of the image forming apparatus. The charging roller 20 brought in abutment on the image carrier 2Y is driven for rotation to follow the rotation of the image carrier, while charging a surface of the image carrier 2Y with a predetermined polarity.

As shown in FIG. 1, in the body 1 of the image forming apparatus, there is disposed a laser writing unit 21 as an exemplary exposing unit, besides the image making unit. An optically modulated laser beam L is projected from the unit 21 to thereby expose the charged surface of the image carrier 2Y as shown in FIG. 2, whereby an electrostatic latent image for a yellow image is formed on the image carrier surface. In the present embodiment, a surface region of the image carrier where the potential is lowered in absolute value by irradiation of the laser beam L constitutes the electrostatic latent image, and a surface region of the image carrier not exposed to the laser beam constitutes a bare skin part. Like this, the exposing unit serves for exposure of a charged surface of an image carrier to form an electrostatic latent image on the image carrier.

The electrostatic latent image is visualized as a yellow toner image by the developing device 22 shown in FIG. 2. The developing device 22 has a development case 23 constituted by a unit case 44 of the developing unit 22, a development roller 24 rotatably supported by the development case 23 and driven for counterclockwise rotation, and agitation rollers 25 rotatably supported by the development case 23. In the development case 23 is accommodated a dry two-component developing agent D containing a carrier and a toner of yellow color with an external additive added, as necessary. There may be employed a dry single-component developing agent containing no carrier or a wet developing agent of liquid state, like developing devices of other image making unit.

The developing agent D are agitated by the agitation rollers 25, so that its toner and carrier are frictionally charged with opposite polarities to each other. Developing agent D in such a condition is carried for conveyance on the development roller 24 which has a bias voltage imposed thereon with an identical polarity to a charged polarity of the toner, and an amount of developing agent restricted by a restriction blade 26 is conveyed in a development region between the development roller 24 and the image carrier 2Y, where the developing agent has its toner electrostatically moved on an electrostatic latent image formed on a surface of the image carrier, so that the electrostatic latent image is visualized as a yellow toner image. If the concentration of toner in the two-component developing agent D accommodated in the development case 23 is lowered so as to be detected by a toner concentration sensor 35, toner is supplied to the two-component developing agent D in the development case 23 as will be described later.

The yellow toner image on the image carrier 2Y is transferred on a sheet of transfer material P to be carried for conveyance by the transfer belt 8 as described, and after the transfer of toner image, post-transfer residue of toner remaining on the image carrier surface is removed by the cleaning device 27. The cleaning device 27 has a cleaning case 28 constituted by part of the unit case 43, a cleaning brush 29 rotatably supported by the cleaning case 28 and driven for rotation in the direction of arrow, and a cleaning blade 30 fixed at the proximal end to the cleaning case 28. The cleaning brush 29 and the cleaning blade 30 abut on the surface of the image carrier 2Y, scraping the post-transfer residue of toner to be removed.

Respective developing devices of the other image making unit 18M, 18C, and 18BK have their development cases for accommodating developing agents containing magenta toner and carrier, cyan toner and carrier, and black toner and carrier, respectively. The image making unit 18M, 18C, and 18BK are not different in constitution from the above-noted image making unit 18Y, excepting that a magenta toner image, a cyan toner image, and a black toner image are formed on the image carriers 2M, 2C, and 2BK, respectively.

In FIG. 1, the image making unit 18Y, 18M, 18C, and 18BK have their carrier units identified by reference characters 41Y, 41M, 41C, and 41BK, respectively, and their developing units identified by reference characters 42Y, 42M, 42C, and 42BK.

The carrier units 41Y, 41M, 41C, and 41BK and developing units 42Y, 42M, 42C, and 42BK of the image making unit 18Y, 18M, 18C, and 18BK are mounted to the body 1 of the image forming apparatus, to be individually independently attachable and detachable, whereby the respective units are each respectively allowed to be drawn out of the image forming apparatus body 1 for repairing and maintenance checks and to be re-set to the image forming apparatus body 1, or for replacement with a new unit. Therefore, such as when a replacement with a new carrier unit is required of a carrier unit of which the image carrier is deteriorated while the developing unit is still sufficiently usable for example, it is possible to replace this carrier unit only, permitting the developing unit to be reused as it is. Like this, it is unnecessary even for a developing unit still sufficiently usable to be replaced, permitting the user to have a reduced economical burden. Further, when a repair of one developing unit is necessitated for example, simply the developing unit can be drawn out of the image forming apparatus body 1 for the repair, with the other developing units as well as their carrier units left attached to the image forming apparatus body 1. Like this, cost for maintenance of the image making unit of the image forming apparatus can be reduced, in addition to that the maintenance work is facilitated.

Although the image making unit have the above-noted advantages implemented by provision of their developing units and carrier units mounted to the image forming apparatus body 1 in an independently attachable and detachable manner, if the developing units and carrier units needed dedicated guide members therefor to enable their attachment and detachment to and from the image forming apparatus body 1, a resultant increase in number of component parts of the image forming apparatus would have caused an increase in cost, as a disadvantage.

In this respect, in the image forming apparatus of the present embodiment, a pair of image making unit neighboring each other has a common guide member for guiding a carrier unit of one image making unit and a developing unit of the other image making unit, when attaching or detaching the carrier unit or the developing unit to or from the image forming apparatus body 1. FIG. 2 shows the image making unit 18Y for forming a yellow toner image on a sheet of transfer material P, and part of the neighboring image making unit 18M. Like this, between image making unit 18Y and 18M neighboring each other, a carrier unit 41Y of one image making unit 18Y and a developing unit 42M of the other image making unit 18M are adapted to be guided by a common guide member 45.

Such a guide member may have an arbitrary suitable configuration. The guide member 45 illustrated in FIG. 2 is constituted, as shown in FIG. 3 as well, by combination of a first guide piece 49 which is constituted as a metallic or hard resin mold integrally formed with a top wall 46, side walls 47 suspended from widthwise side edges of the top wall 46, and inward flanges 48 projecting from lower ends of the side walls 47 in mutually approaching directions, and a second guide piece 50 (not shown in FIG. 3) which is made of a metal or hard resin in a substantially L shape in cross section and integrally fixed on the top wall 46 of the first guide piece 9.

Figure 3:
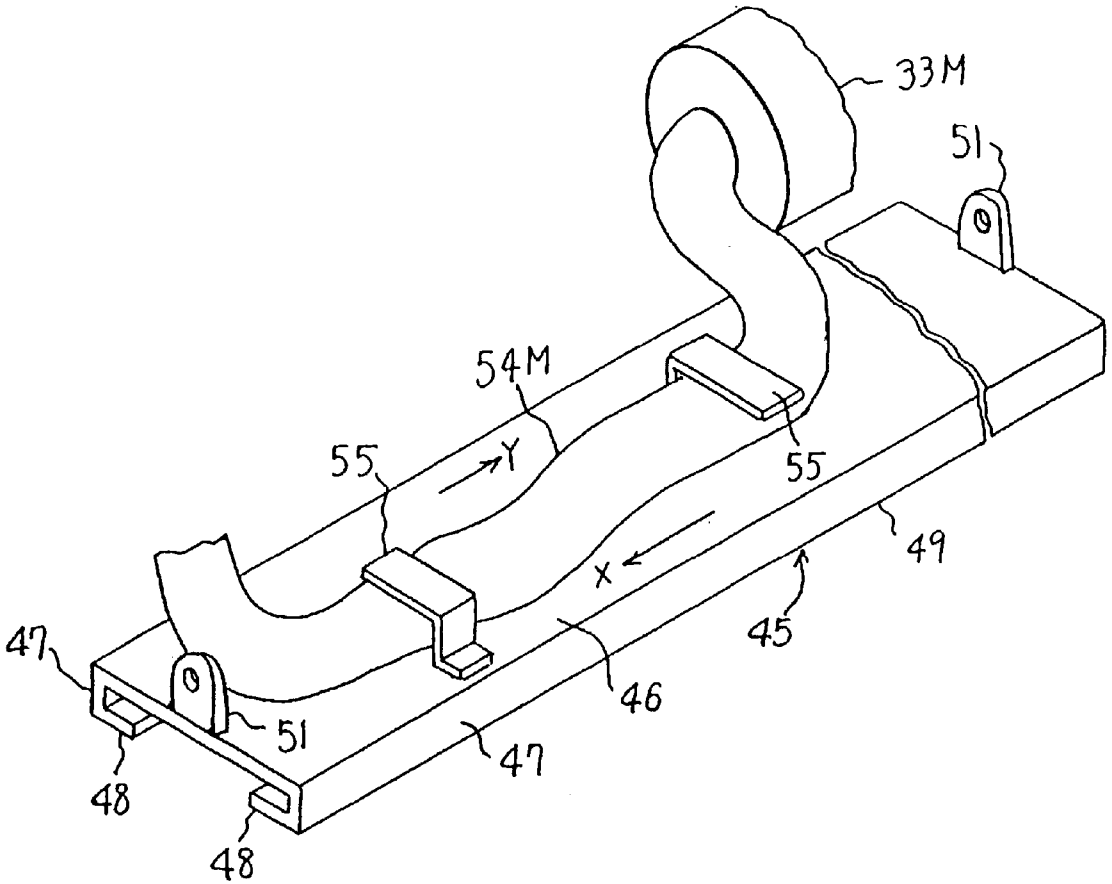
FIG. 3 is a perspective view of the guide member of FIG. 2, with a second guide piece omitted.

The guide member 45 extends, as shown in FIG. 3, in front and rear directions X and Y of the image forming apparatus body 1, that is in a perpendicular direction to the drawing sheet of FIG. 2, and respective tongues 51 integrally provided both longitudinal ends of the top wall 46 of the guide member 45 are fixed to a frame (not shown) of the image forming apparatus body 1, for example by screws (not shown).

As shown in FIG. 2, the unit case 43 of the carrier unit 41 of the one image making unit 18Y has in its upper part a pair of guided pieces 52 which are placed on the flanges 48 of the first guide member 49, respectively, for engagement therewith to be slidable in the longitudinal direction of the guide member 45. Likewise, also a unit case 44 of the developing unit 42M of the other image making unit 18M has an engagement part 53 formed in a substantially invert-U shape, which engagement part 53 fits on the second guide piece 50 of the guide member 45, in a manner slidable in the longitudinal direction of the guide member 45.

By the arrangement described, when the carrier unit 41Y is drawn to this side (in the direction of arrow X in FIG. 3) of the image forming apparatus body 1, the carrier unit 41Y is allowed to be guided alone by the first guide piece 49 of the guide member 45, so that it is slid to this side of the image forming apparatus body 1, to be removed from the image forming apparatus body. To the contrary, by pushing the carrier unit 41Y into the depth side (in the direction of arrow Y in FIG. 3) with the guided pieces 52 respectively engaged on the flanges 48 of the first guide piece 49, it can be set in a predetermined position relative to the image forming apparatus body. Quite likewise, the developing unit 42M being guided by the second guide piece 50 of the guide member 45 can be drawn to this side of the image forming apparatus body 1, to be removed from the image forming apparatus body, or contrary thereto the developing unit 42M can be pushed to the depth side, to be set in a predetermined position inside the image forming apparatus body.

When the carrier unit 41Y and the developing unit 42M are installed in their predetermined positions relative to the image forming apparatus body 1 as shown in FIG. 2, unshown positioning holes and positioning pins provided on the side of the respective units 41Y and 42M and the side of the frame of the image forming apparatus body fit to each other, so that the carrier unit 41Y and the developing unit 42M are correctly set in position to the image forming apparatus body 1. The positioning holes and the positioning pins constitute as a whole an example of positioning unit for positioning the carrier unit 41Y and the developing unit 42M relative to the image forming apparatus body. Other developing units 42Y, 42C, and 42BK and other carrier units 41M, 41C, and 41BK also are positioned to be set to the image forming apparatus body by similar positioning unit.

The carrier unit 41M of the image making unit 18Y shown in FIG. 1 and the developing unit 42C of the image making unit 18C neighboring thereto can also be guided in attachment and detachment by a common guide member (not shown) constituted in quite the same manner as described, and further, the carrier unit 41C of the image making unit 18C and the developing unit 42BK of the image making unit 18BK neighboring thereto can also be guided by a common guide member (not shown) constituted in quite the same manner as described, so that those units can be positioned to be set to the image forming apparatus body.

Although the developing unit 42Y of the image making unit 18Y shown in FIG. 2 can also be so constituted as to be guided by a guide member constituted quite like the above-noted guide member 45, because no image making unit exist upstream the developing unit 42Y of the image making unit 18Y positioned most upstream in the moving direction of transfer material, this developing unit 42Y may be so constituted as to be guided by a guide member more simple in structure than the above-noted guide member 45. In an embodiment shown in FIG. 2, to a guide member 45A constituted like the second guide piece 50 of the guide member 45, the engagement part 53 of a substantially invert-U shape provided to the developing unit 42M of the image making unit 18Y is slidably fitted. Also the guide member 45A extends in the front and rear directions of the image forming apparatus body 1 and is fixed to the frame of the image forming apparatus body 1, to guide the developing unit 42Y in attachment and detachment of this developing unit 42Y to and from the image forming apparatus body 1.

Further, although the carrier unit 41BK of the image making unit 18BK positioned most downstream in the moving direction of transfer material can also be so constituted as to be guided by a guide member constituted like the guide member 45, the carrier unit 41BK may be so constituted as to be guided by a guide member constituted simply with the first guide piece 49 of the guide member 45. That is, a guide member (not shown) constituted like the first guide piece 49 of the guide member 45 is fixed to the frame of the image forming apparatus body 1, and on respective flanges of this guide member, respective guided pieces (not shown) formed on a unit case of the carrier unit 41BK are respectively slidably placed for engagement, so that the carrier unit 41BK being guided by this guide member can be moved in the front and rear directions of the image forming apparatus body 1, for attachment and detachment of the carrier unit 41BK.

As described, a guide member for guiding the developing unit 42Y of the image making unit 18Y to be most upstream in the conveyance direction of the transfer material and the carrier unit 41BK of the image making unit 18BK to be most downstream is simplified in structure, thereby allowing for the cost to be reduced.

It is preferable for the transfer belt 8 to be so constituted as to retreat in a position spaced from an image carrier in attachment and detachment of a carrier unit or a developing unit, so that a surface of the image carrier can be prevented from being injured.

According to the arrangement described, guide members to be provided to the image forming apparatus body 1 can be reduced in number, allowing for cost reduction of the image forming apparatus. For example, in the embodiment shown in which image making unit are four in number, if their carrier units and developing units were to be respectively guided by guide members, the guide members should have been eight in number. In the present embodiment, however, simple provision of five guide members can do.

There may be an arrangement in which carrier unit and developing unit of each image making unit 18Y, 18M, 18C, or 18BK are guided by a common guide member. For example, the developing unit 42Y and the carrier unit 41Y of the image making unit 18Y may be guided by a common guide member. By this arrangement also, the number of guide members in entirety of the image forming apparatus can be reduced. To this point, in such a case of image making unit as shown in FIG. 2 in which a laser beam L passes a region between the carrier unit 41Y and the developing unit 42Y, if the carrier unit 41Y and the developing unit 42Y were constitured so as to be guided by a common guide member, and optical path of the laser beam L would have been interrupted by the guide member, and it is difficult to guide the carrier unit 41Y and the developing unit 42Y by a common guide member. However, in the present embodiment, because the image forming apparatus is so constituted as to guide a carrier unit and a developing unit of image making unit neighboring each other by a common guide member, it is ensured to guide the carrier unit and the developing unit by a small-size guide member 45, without interrupting the optical path of the laser beam L by the guide member 45.

As seen from FIG. 1 and FIG. 2, in the image forming apparatus of the present embodiment, the sheet of transfer material P to be conveyed by the transfer belt 8 has a path of conveyance obliquely upwardly inclined from the upstream end to the downstream end. Therefore, an image making unit positioned downstream in the conveyance direction of transfer material is mounted in a higher position than an image making unit positioned upstream. Such an image making unit has its carrier unit positioned downstream of its developing unit in the conveyance direction of transfer material.

Moreover, at least part of the carrier unit, a part S of the carrier unit 41Y in the embodiment shown in FIG. 2, is positioned under the developing unit 42M. Like this, at least part of the carrier unit 41Y of the image making unit 18Y positioned upstream in the conveyance direction of transfer material between the two image making unit 18Y and 18M neighboring each other is so constituted as to be positioned under the developing unit 42M of the image making unit 18M positioned downstream in the conveyance direction of transfer material, thereby allowing the plurality of image making unit 18Y and 18M to be disposed in a compact collecting manner in a horizontal direction. Also between other image making unit neighboring each other, there is employed a similar arrangement. The image forming apparatus body 1 is thereby allowed to have a small-sized horizontal width, permitting an installation space of the image forming apparatus to be made small.

Further, as seen from FIG. 2, the carrier unit 41Y of the image making unit 18Y positioned upstream is supported by the flanges 48 as lower parts of the guide member 45, and the developing unit 42M of the image making unit 18M neighboring thereto at the downstream side is supported by the second guide piece 50 as an upper part of the same guide member 45. Also between other image making unit neighboring each other, there is employed a similar arrangement.

Like this, even in a case of arrangement in which between two image making unit neighboring each other, a carrier unit of one image making unit positioned upstream in a conveyance direction of transfer material is supported by a lower part of a guide member than a developing unit of the other image making unit positioned downstream in the conveyance direction of transfer material so that at least part of the carrier unit of the image making unit positioned upstream in the conveyance direction of transfer material is positioned under the developing unit of the image making unit positioned downstream in the conveyance direction of transfer material, the both units can be supported in a compact collecting manner, without interference therebetween.

Further, as shown in FIG. 2, the carrier unit 41Y of the image making unit 18Y positioned upstream is supported by suspending from the flanges 48 of the guide member 45, and the developing unit 42M of the image making unit 18M positioned downstream is supported in a condition in which it is fitted from above on the second guide piece 50 as an upper part of the guide member 45. Also between other image making unit neighboring each other, there is employed a similar arrangement.

Like this, by arrangement in which between two image making unit neighboring each other, a carrier unit of one image making unit positioned upstream in a conveyance direction of transfer material is supported by a guide member in a condition in which it is suspended from the guide member, and a developing unit of the other image making unit positioned downstream in the conveyance direction of transfer material is supported in a condition in which it is fitted on an upper part of the guide member, the both units can be supported in a compact collecting manner in addition to that, because the carrier unit is suspended, its supporting stability can be enhanced.

Further, in the embodiment shown in FIG. 2, the carrier unit 41Y is supported by the two flanges 48 of the guide member 45, with the image carrier 2Y positioned therebelow. Also other carrier units are likewise arranged. Like this, by arrangement in which a carrier unit is suspended from a guide member at two points, having an image carrier of the carrier unit positioned under the two suspending parts, because the carrier unit is supported by suspending at the two points, its supporting stability can be enhanced in addition to that, because the image carrier relatively large in weight in the carrier unit is positioned under the suspending parts at two points, the supporting stability of the carrier unit can be the more enhanced.

For the same reason, by arrangement in which a carrier unit is suspended at two points of a guide member spaced from each other in a horizontal direction, with the center of gravity of an image carrier of the carrier unit positioned under an area AR (FIG. 2) between both suspending parts, it is ensured that the carrier unit has an enhanced supporting stability.

Figure 4:
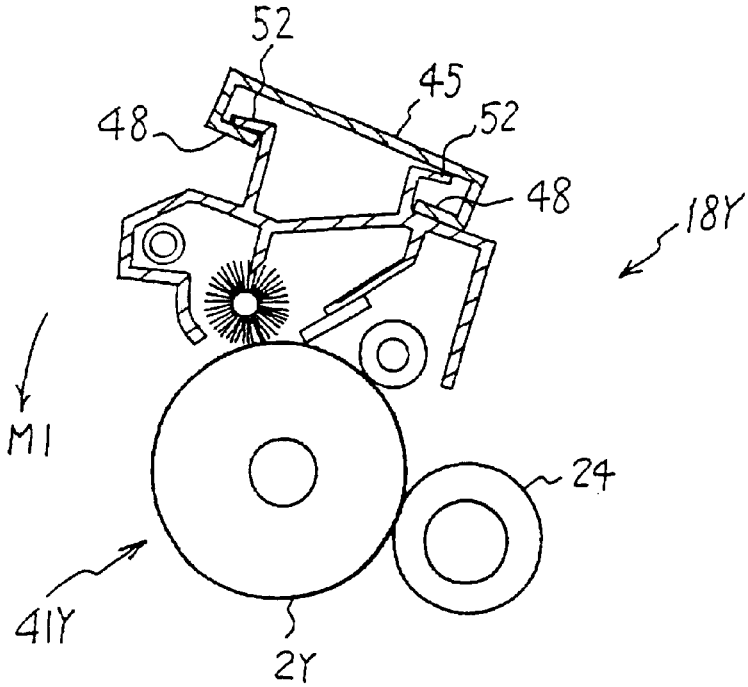
FIG. 4 is a view of a guide member according to a modification of the present embodiment, with a second guide piece omitted.

As shown in FIG. 4, such an arrangement also is applicable that the guide member 45 is inclined for disposition to have both flanges 48 support the guided pieces 52 of the carrier unit 41Y. Also for other carrier units, like arrangement can be employed.

However, in such arrangement, the carrier unit 41Y of the image making unit 18Y has a moment M1 acting thereon due to its own weight, and in the case of an arrangement in which the guided pieces 52 can play relative to the flanges 48, when the carrier unit 41Y is guided by the guide member 45 for its attachment or detachment to or from the image forming apparatus body, the carrier unit 41Y tends to incline in an acting direction of the moment M1, causing the image carrier 2Y to interfere with the development roller 24 of the same image making unit 18Y, with the fear of injuring a surface of the image carrier 2Y. Further, as the guide member 45 is inclined, when the operator makes the guided pieces 52 of the carrier unit 41Y engage with the flanges 48 of the guide member 45 to mount the carrier unit 41Y to the image forming apparatus body, the visibility of the engaging parts becomes bad, reducing the operability of the engagement operation.

Figure 5:
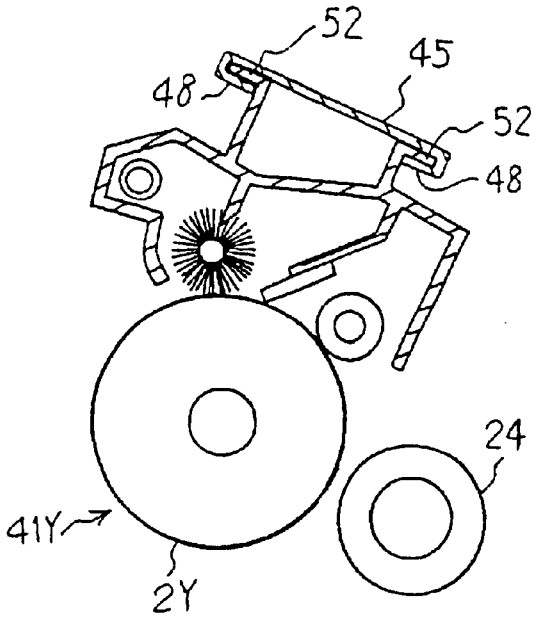
FIG. 5 is a view of a guide member according to another modification of the present embodiment, with a second guide piece omitted.

As shown in FIG. 5, it also is possible to support the carrier unit 41Y by the guide member 45 so that the guided pieces 52 of the carrier unit 41Y are kept from playing relative to the guide member 45, that is, from rattling, whereby in attachment or detachment of the carrier unit 41Y this unit 41Y can be prevented from inclining as shown in FIG. 4, thus from causing the image carrier 2Y to interfere with the development roller 24. However, in such arrangement, it becomes more difficult to have the guided pieces 52 of the carrier unit 41Y engage with the flanges 48 of the guide member 45, with the more reduced operability.

To this point, in the image forming apparatus shown in FIG. 2, the carrier unit 41Y and the developing unit 42Y, as they are supported by the guide member 45, are substantially horizontally pushed into or drawn out of the image forming apparatus body 1, to be attached to or detached from the image forming apparatus body 1, while the carrier unit 41Y is supported in a horizontal position by the guide member 45 so that no moment due to an own weight of the carrier unit 41Y act on the carrier unit 41Y in attachment or detachment of the carrier unit 41Y to the image forming apparatus body. The carrier unit 41Y is thereby allowed, even when playably fitted to the guide member 45, to be kept from inclining in attachment or detachment of the carrier unit 41Y, whereby in the attachment or detachment the image carrier 2Y of the image making unit 18Y is prevented against interference with the developing roller 24 of the same image making unit 18Y, in addition to that the carrier unit 41Y can be engaged with the guide member 45 in a facilitated manner. Also for other carrier units and developing units, like arrangement is employed.

As described, it is possible to support a carrier unit by a guide member in any of fashions shown in FIG. 2, FIG. 4 and FIG. 5, while the supporting fashion shown in FIG. 2 is most preferable thereamong.

Further, as shown in FIG. 2, the developing unit 42M is engaged, by the engagement part 53 at one-end side in its horizontal direction, with the second guide piece 50 of the guide member 45, to be supported by the guide member 45. Such a supporting arrangement permits the small guide member 45 to support both of the developing unit 42Y and the carrier unit 41Y. However, as the developing unit 42Y is supported simply at the one-end side by the guide member 45, the developing unit 42Y has a moment M2 acting thereon due to its own weight. This is alike to the other developing units, and also on the developing unit 42Y of the image making unit 18Y shown in FIG. 2, there is acting the moment M2 due to the own weight. As such a moment M2 is acting on the developing unit, in its attachment or detachment, the development roller 24 of the developing unit is caused to interfere with an image carrier in opposition thereto, with the fear of injuring the image carrier.

In this respect, in the example of arrangement shown in FIG. 2, an auxiliary guide member 60 extending in parallel to the guide member 45 is fixed to the frame of the image forming apparatus body so that, in attachment or detachment of the developing unit 42Y, an abutment part 61 as part of the unit case 44 of the developing unit 42Y abuts on the auxiliary guide member 60 to prevent the developing unit 42Y from greatly inclining. Also in any developing unit else, the developing unit is quite likewise prevented by an auxiliary guide member from being greatly inclined by a moment M2. Thereby preventable is such a defect in attachment or detachment of the developing unit that its development roller 24 might otherwise have interfered with an image carrier, giving an injury to the image carrier.

As described, in this embodiment of image forming apparatus in which in attachment or detachment of a developing unit to the image forming apparatus body the developing unit is supported by a guide member so that a moment due to an own weight of the developing unit acts on the developing unit, by provision of an auxiliary guide member for preventing the developing unit from being inclined by a moment due to the own weight in attachment or detachment of the developing unit to or from the image forming apparatus body it is permitted to prevent an occurrence of a defect due to inclination of the developing unit in the attachment or detachment of the developing unit.

Figure 6:
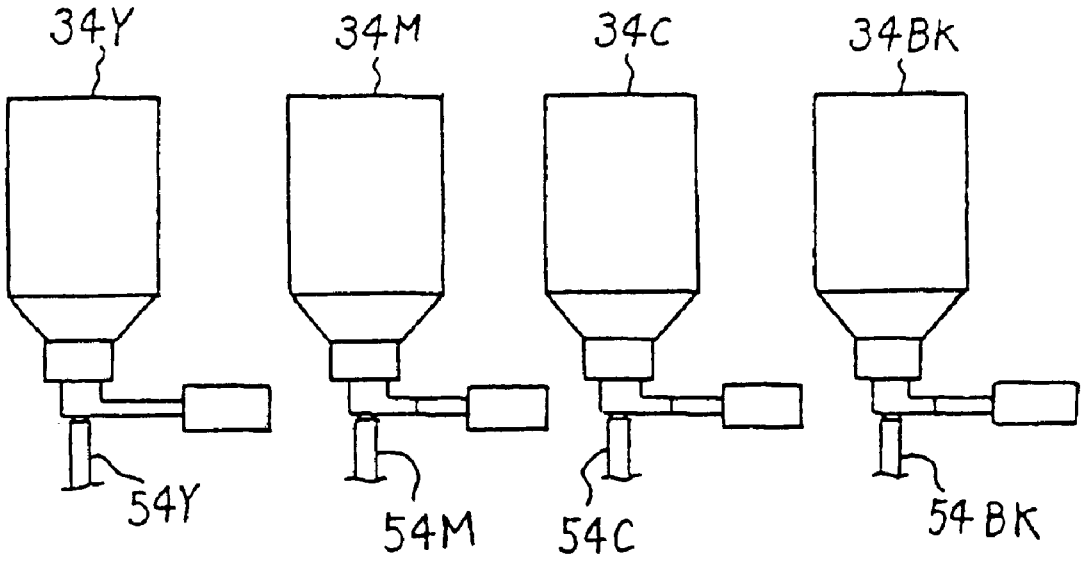
FIG. 6 is a view of a toner accommodating container along arrow VI of FIG. 1.

As shown in FIG. 6, the image forming apparatus body 1 has disposed therein toner accommodation containers 34Y, 34M, 34C, and 34Bk for accommodating toners of respective colors to be supplied to the developing devices of the respective image making unit 18Y, 18M, 18C, and 18BK, and as shown in FIG. 1, in correspondence to the developing devices of the image making unit, toner transfer pumps 33Y, 33M, 33C, and 33BK are respectively fixed to be supported in the image forming apparatus body. Toner discharging outlets of the toner accommodation containers 34Y to 34BK are connected to the toner transfer pumps 33Y to 33BK, respectively, by conduits 54Y, 54M, 54C, and 54BK constituted with flexible tubes for example.

As described, when a lowered toner concentration of a two-component developing agent D accommodated in the development case 23 of the developing device 22 is detected by the toner concentration sensor 35, a toner transfer pump corresponding to a developing device at which the detection is made starts operation, whereby a toner in a toner accommodation container connected to the toner transfer pump is supplied by this toner transfer pump via an opening (not shown) to the development case 23 of the developing device 22.

As described, in this embodiment of image forming apparatus, there are provided toner transfer pumps 33Y to 33BK for transferring toners to the developing devices 22 of the respective image making unit 18Y to 18BK, and toner accommodation containers 34Y to 34BK connected to the toner transfer pumps 33Y to 33BK via conduits 54Y to 54BK for accommodating toners to be sent to the toner transfer pumps 33Y to 33BK, while the conduits 54Y to 54BK are disposed at least partially on the guide member 45. In a condition shown in FIG. 3, the conduit 54M for interconnection between the toner accommodation container 34M and the toner transfer pump 33M for transferring a toner to the developing device of the image making unit 18M is placed partially on the top wall 46 of the guide member 45 and held by a clamp 55 to the top wall 46.

As described, by arrangement in which conduits are disposed on the guide member 45 and this guide member 45 concurrently serves as a support member for supporting the conduits, dedicated support members for supporting the conduits can be eliminated or reduced in number, allowing for cost reduction and structural simplification to be achieved of the image forming apparatus.

The present invention is applicable also to a variety of types of image forming apparatuses other than the shown types, such as a type of image forming apparatus in which, for example, a toner image on a respective image carrier is primary-transferred on a sheet of transfer material constituted as an intermediate transfer body, not a transfer material as a final recording medium, and then a toner image on the intermediate transfer body is secondary-transferred on a transfer material as a final recording medium.

According to the first to ninth aspects of the invention, the number of guide members can be reduced, thereby allowing for a reduction in cost of an image forming apparatus.

In particular, according to the second and third aspects of the invention, a plurality of image making unit can be horizontally collected to be arranged compact, allowing for a horizontal width of an image forming apparatus to be small-sized.

Moreover, according to the fourth to sixth aspects of the invention, a carrier unit is allowed to have an enhanced supporting stability.

Further, according to the seventh aspect of the invention, a carrier unit can be attached and detached, with an effective suppression achieved in tendency for the unit to incline.

Still more, according to the eighth aspect of the invention, a development unit can be attached and detached, with an effective suppression achieved in tendency for the unit to incline.

Yet more, according to the ninth aspect of the invention, because a guide member has a function of supporting a guide pipe, cost of an image forming apparatus can be reduced.

The present documents incorporates by reference the entire contents of Japanese priority documents, 2000-168146 filed in Japan on Jun. 5, 2000 and 2001-136258 filed in Japan on May 7, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a plurality of image making units each including a carrier unit and a developing unit, the carrier unit having an image carrier for forming a latent image thereon, the developing unit having a developing device configured to develop the latent image formed on a respective one of the image carriers into a toner image; and a plurality of common guide members each configured to guide a respective one of the developing units in one of the plurality of image making units and a respective one of the carrier units in another one of the plurality of image making units when the plurality of image making units are attached to or detached from the image forming apparatus.

2. An image forming apparatus according to claim 1, wherein the plurality of image making units are positioned in the image forming apparatus such that the carrier unit in an upstream one of the plurality of image making units is positioned under the developing unit in a downstream one adjacent to the upstream one of the plurality of image making units with respect to a transfer direction of a transfer material.

3. An image forming apparatus according to claim 2, wherein the plurality of common guide members are each configured to support a respective one of the carrier units such that the carrier units are held at positions lower than the developing units in the image making units positioned downstream in the transfer direction of the transfer material, respectively.

4. An image forming apparatus according to claim 3, wherein the plurality of common guide members are each configured to suspend a respective one of the carrier units and support a respective one of the developing units in the image making units positioned downstream in the transfer direction of the transfer material on the upper part thereof.

5. An image forming apparatus according to claim 4, wherein:

the plurality of common guide members each include a plurality of suspending parts configured to slidably suspend a respective one of the carrier units; and the plurality of common guide members are each positioned above a respective one of the image carriers.

6. An image forming apparatus according to claim 5, wherein the plurality of suspending parts are spaced from each other in a horizontal direction of the plurality of common guide members such that a center of gravity of the respective one of the carrier units is positioned under an area between the suspending parts.

7. An image forming apparatus according to claim 1, wherein the plurality of common guide members are each configured to slidably support a respective one of the carrier units in respective horizontal positions such that the carrier units are pushed into or drawn out from the image forming apparatus substantially in a horizontal direction relative to the image forming apparatus.

8. An image forming apparatus according to claim 1, wherein:

the plurality of common guide members are each configured to slidably support a respective one of the carrier units in respective horizontal positions such that the carrier units are pushed into or drawn out from the image forming apparatus substantially in a horizontal direction relative to the image forming apparatus and support a respective one of the developing units; and the image forming apparatus further comprises a plurality of auxiliary guide members each configured to prevent a respective one of the developing units from being inclined by the moment.

9. An image forming apparatus according to claim 1, further comprising:

a plurality of toner transfer pumps for transferring toners to the developing devices in the image making units, respectively;

a plurality of toner containers accommodating toners to be sent to the toner transfer pumps; and a plurality of conduits connecting the plurality of toner transfer pumps and the plurality of toner containers, respectively, and at least partially disposed on a respective one of the plurality of common guide members.

10. An image forming apparatus comprising:

a plurality of image making units each including a carrier unit and a developing unit, the carrier unit having an image carrier for forming a latent image thereon, the developing unit having a developing device configured to develop the latent image formed on a respective one of the image carriers into a toner image; and common guiding means for guiding a respective one of the developing units in one of the plurality of image making units and a respective one of the carrier units in another one of the plurality of image making units when the plurality of image making units are attached to or detached from the image forming apparatus.

* * * * *